US005977054A

United States Patent [19]

Wierenga

[11] Patent Number: 5,977,054

[45] Date of Patent: Nov. 2, 1999

[54] MILDLY ACIDIC HARD SURFACE CLEANING COMPOSITIONS CONTAINING AMINE OXIDE DETERGENT SURFACTANTS

[75] Inventor: Thomas James Wierenga, Cincinnati, Ohio

[73] Assignee: The Procter & Gamble Company, Cincinnati, Ohio

[21] Appl. No.: 08/730,167

[22] Filed: Oct. 15, 1996

Related U.S. Application Data

[63] Continuation of application No. 08/412,622, Mar. 29, 1995, abandoned, which is a continuation-in-part of application No. 08/115,294, Sep. 1, 1993, abandoned.

[51] Int. Cl.[6] ..... C11D 1/75; C11D 7/08; C11D 3/48

[52] U.S. Cl. ..... 510/503; 510/191; 510/197; 510/199; 510/202; 510/210; 510/212; 510/220; 510/221; 510/223; 510/229; 510/238; 510/245; 510/253; 510/409; 510/410; 510/411; 510/423; 510/453; 510/488

[58] Field of Search ..... 510/191, 197, 510/199, 202, 210, 212, 220, 221, 223, 229, 238, 245, 253, 409, 410, 411, 423, 453, 503, 488

[56] References Cited

U.S. PATENT DOCUMENTS

| | | | |
|---|---|---|---|
| H1635 | 3/1997 | Vander Meer | 510/220 |
| 3,275,673 | 9/1966 | Barlow | 260/459 |
| 3,928,249 | 12/1975 | Nunziata et al. | 252/526 |
| 3,943,234 | 3/1976 | Roggenkamp | 424/343 |
| 3,983,079 | 9/1976 | Spadini et al. | 252/545 |
| 4,058,489 | 11/1977 | Hellsten | 252/547 |
| 4,316,824 | 2/1982 | Pancheri | 252/551 |
| 4,320,033 | 3/1982 | Yoshikawa | 252/547 |
| 4,338,216 | 7/1982 | Earl et al. | 252/311 |
| 4,537,706 | 8/1985 | Severson, Jr. | 252/545 |
| 4,561,998 | 12/1985 | Wertz et al. | 252/547 |
| 4,678,606 | 7/1987 | Akhter et al. | 252/542 |
| 4,776,974 | 10/1988 | Stanton et al. | 252/106 |
| 5,000,867 | 3/1991 | Heinhuis-Walther et al. | 252/106 |
| 5,075,501 | 12/1991 | Borland et al. | 564/297 |
| 5,244,593 | 9/1993 | Roselle et al. | 252/99 |
| 5,244,652 | 9/1993 | Michaels | 424/54 |
| 5,364,551 | 11/1994 | Lentsch et al. | 252/156 |
| 5,389,306 | 2/1995 | Wierenga et al. | 252/547 |
| 5,399,296 | 3/1995 | Wierenga et al. | 252/547 |
| 5,409,630 | 4/1995 | Lysy et al. | 252/174.23 |
| 5,460,742 | 10/1995 | Cavanaugh et al. | 252/144 |
| 5,545,340 | 8/1996 | Wahl et al. | 510/517 |
| 5,691,291 | 11/1997 | Wierenga et al. | 510/214 |

FOREIGN PATENT DOCUMENTS

| | | | |
|---|---|---|---|
| 0 131 527 | 1/1985 | European Pat. Off. | C11D 1/75 |
| 0 130 786 | 9/1985 | European Pat. Off. | C11D 7/08 |
| 0 265 979 | 4/1988 | European Pat. Off. | C11D 1/62 |
| 800181457 | 12/1980 | Japan | C11D 1/82 |
| 860289813 | 12/1986 | Japan | C11D 3/37 |
| 1240469 | 7/1971 | United Kingdom | C23G 1/02 |

OTHER PUBLICATIONS

McCutcheon's Emulsifier & Detergents 1982 No month available p. 215.

*Primary Examiner*—Yogendra Gupta
*Assistant Examiner*—Charles Boyer
*Attorney, Agent, or Firm*—Karen F. Clark; Daniel F. Nesbitt; Jacobus C. Rasser

[57] ABSTRACT

Disclosed are mildly acidic liquid compositions for use in cleaning hard surfaces. The compositions contain from about 1% to about 60% of an amine oxide detergent surfactant, an aqueous carrier liquid, and an acidifying agent having a $pK_a$ of less than about 6.0. The compositions contain enough of the acidifying agent to protonate at least about 10% of the amine oxide species within the compositions and to provide a composition pH of between about 3 and 7. These no-rinse liquid hard surface cleaning compositions have excellent cleaning properties, they do not leave a visible residue when they dry, and they cause minimal or no staining of vinyl surfaces. Also disclosed are a method for cleaning vinyl surfaces using the liquid compositions, and non-liquid compositions from which the mildly acidic liquid compositions can easily be obtained by adding an aqueous liquid.

9 Claims, 1 Drawing Sheet

% Particulate Soil Removal
80
70
60
50
40
30
20
10
0
A
B
C
D
E
F
0
1
2
3
4
5
Residue (0-5)

MILDLY ACIDIC HARD SURFACE CLEANING COMPOSITIONS CONTAINING AMINE OXIDE DETERGENT SURFACTANTS

This is a continuation of application Ser. No. 08/412,622, filed on Mar. 29, 1995, now abandoned, which is a continuation-in-part of application Ser. No. 08/115,294, filed on Sep. 1, 1993, now abandoned.

FIELD OF THE INVENTION

This invention relates to no-rinse hard surface cleaners which are mildly acidic and contain an amine oxide detergent surfactant. These compositions will effectively clean hard surfaces without leaving a visible residue when they dry and they will cause minimal or no staining of vinyl surfaces. The invention also relates to a process for cleaning vinyl surfaces using the compositions.

BACKGROUND OF THE INVENTION

The use of amine oxide detergent surfactants in cleaning compositions is well known. Amine oxides are most commonly used as cosurfactants to boost and maintain suds formation in laundry, shampoo, and dishwashing detergent compositions. Amine oxides have occasionally been used in hard surface cleaners such as acidic toilet bowl cleaners (pH of 2 or less), dishwashing liquids containing occlusive emollients (pH of 4 to 6.9), and selected non-acidic (neutral to alkaline) hard surface cleaners. In non-acidic hard surface cleaners, amine oxide detergent surfactants are essentially non-ionic ($pK_a$ between about 4 and about 6). These non-ionic amine oxides provide good cleaning properties and leave little or no visible residue on hard surfaces when they dry.

It was discovered, however, that non-acidic hard surface cleaners containing amine oxides will stain or discolor vinyl (polyvinyl chloride) surfaces. The staining amounts to a light yellow to dark brown discoloration of the vinyl. Staining will also occur on waxed vinyl surfaces where areas of wax are wor thin or are chipped away so that the amine oxide can come in direct contact with the vinyl.

It is therefore an object of the present invention to provide a hard surface cleaning composition containing amine oxide detergent surfactants that will cause minimal or no vinyl staining. It is a further object of the invention to provide such a composition which will also have superior cleaning properties and will not leave a visible residue on cleaned surfaces. It is also an object of this invention to provide a process for cleaning vinyl surfaces using such a composition.

SUMMARY OF THE INVENTION

In its product aspect, the present invention relates to mildly acidic, liquid hard surface cleaning compositions comprising from about 1% to about 60% of an amine oxide detergent surfactant, an aqueous carrier liquid, and an acidifying agent having a $pK_a$ of below about 6.0. The compositions contain the acidifying agent in an amount sufficient to establish a composition pH of between about 3 and 7 and in an amount sufficient to protonate at least about 10% of the amine oxide detergent surfactant in the composition. The present invention also embodies a non-liquid formulation from which the liquid composition can be derived. The non-liquid formulation is essentially the liquid composition wherein the amount of the aqueous carrier liquid is reduced (e.g., gel) or eliminated (e.g., granules).

In its method aspect, the present invention relates to a method for cleaning vinyl surfaces using the liquid compositions herein. In accordance with the method, the liquid compositions are applied in diluted or undiluted form to a vinyl surface. The diluted compositions have a pH of between about 3 and 7 and comprise from about 0.004% to about 1.0% of the amine oxide detergent surfactant, at least about 10% of which is protonated. The diluted or undiluted liquid compositions are applied to a vinyl surface, wiped with a porous material, and allowed to dry.

The liquid compositions can be used as no-rinse hard surface cleaners on floors, walls, etc. It was found that non-acidic liquid cleaning compositions containing amine oxides will stain vinyl surfaces. The liquid compositions of the present invention, however, will cause minimal or no vinyl staining. Moreover, the liquid compositions have excellent cleaning properties and will leave little or no visible residue when they dry.

DETAILED DESCRIPTION OF THE INVENTION

Figure 1:
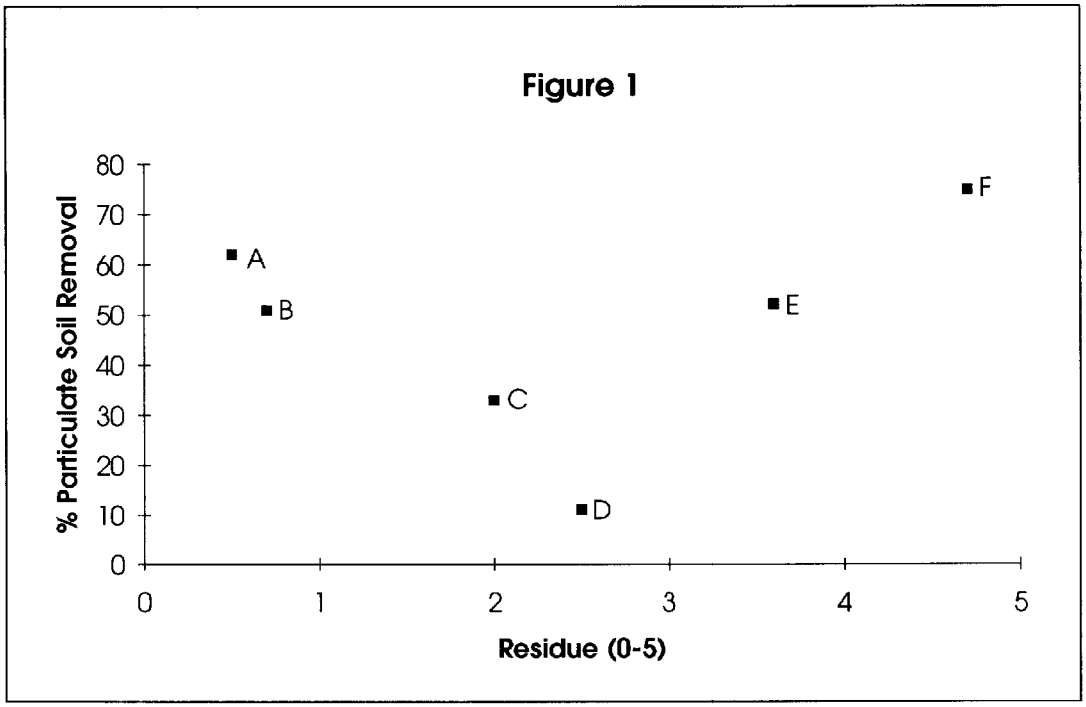
FIG. 1 is a graph which shows the cleaning and residue profiles of several hard surface cleaners. The horizontal axis represents residue profiles based on a 0.0 (extremely visible residue) to 5.0 (no visible residue) scale. The vertical axis represents cleaning profiles (particulate soil removal) based on the percentage of soil removed via testing methods described hereinafter. Points A–E on the graph represent these profiles for commercially available hard surface cleaners. Point F represents these profiles for a composition of the present invention.

The liquid compositions of the present invention comprise three key elements: 1) an amine oxide detergent surfactant, 2) an acidifying agent, and 3) an aqueous carrier liquid. The liquid compositions can be used in diluted or undiluted form on hard surfaces.

As used herein, "mildly acidic" means a pH of between about 3.0 and 7.0. All pH values herein are measured in aqueous systems at 25° C. (77° F.).

As used herein, "vinyl" means material or surfaces containing polyvinyl chloride. Such material or surfaces can be waxed or unwaxed.

As used herein, "non-liquid" means granular, powder or gel formulations which can be diluted with the aqueous carrier liquid described hereinafter to produce a mildly acidic liquid hard surface cleaning composition of the present invention.

As used herein, "liquid compositions" mean the mildly acidic, liquid hard surface cleaning compositions of the present invention, or aqueous dilutions thereof.

As used herein, all percentages and ratios are based on weight unless otherwise specified.

The present invention, in its product and process aspects, is described in detail as follows.

Amine Oxide Detergent Surfactant

The compositions comprise an amine oxide detergent surfactant which typically has a $pK_a$ of from about 2 to about 6. As described hereinafter, at least about 10% of the amine oxide species within the composition must be in cationic (protonated) form.

Specifically, the compositions comprise from about 1% to about 60%, preferably from about 2% to about 50%, more preferably from about 2.5% to about 40%, of an amine oxide detergent surfactant. The amine oxide preferably has the formula RR'R"NO, where R is a substituted or unsubstituted alkyl or alkene group containing from about 8 to about 30, preferably from about 8 to about 18, carbon atoms. Groups R' and R" are each substituted or unsubstituted alkyl or alkene groups containing from about 1 to about 18, preferably from about 1 to about 4, carbon atoms. More preferably, R' and R" are each methyl groups, examples of which include dodecyldimethyl amine oxide, tetradecyldimethyl amine oxide, hexadecyldimethyl amine oxide, octadecyldimethyl amine oxide, and coconutalkyldimethyl amine oxides.

The amine oxide detergent surfactant can be prepared by known and conventional methods. One such method involves the oxidation of tertiary amines in the manner set forth in U.S. Pat. No. 3,223,647 and British Patent 437,566. In general terms, amine oxides are prepared by the controlled oxidation of the corresponding tertiary amines.

Examples of suitable amine oxide detergent surfactants for use in the compositions include dodecyldimethyl amine oxide, tridecyldimethyl amine oxide, tetradecyldimethyl amine oxide, pentadecyldimethyl amine oxide, hexadecyldimethyl amine oxide, heptadecyldimethyl amine oxide, octadecyldimethyl amine oxide, docecyldiethyl amine oxide, tetradecyldimethyl amine oxide, hexadecyldiethyl amine oxide, octadecyldiethyl amine oxide, dodecyldipropyl amine oxide, tetradecyldipropyl amine oxide, hexadecyldipropyl amine oxide, octadecyldipropyl amine oxide, dodecyldibutyl amine oxide, tetradecyldibutyl amine oxide, hexadecyldibutyl amine oxide, octadecyldibutyl amine oxide, dodecylmethylethyl amine oxide, tetradecylethylpropyl amine oxide, hexadecylpropylbutyl amine oxide, and octadecylmethylbutyl amine oxide.

Also useful are the amine oxide detergent surfactants which are prepared by the oxidation of tertiary amines prepared from mixed alcohols obtainable from coconut oil. Such coconutalkyl amine oxides are preferred from an economic standpoint inasmuch as it is not necessary for the present purposes, to separate the mixed alcohol fractions into their pure components to secure the pure chain length fractions of the amine oxides.

Acidifying Agent

It was found that amine oxide staining of vinyl surfaces can be reduced or eliminated by using certain acidifying agents in the liquid composition. These acidifying agents are used to protonate a minimum percentage of amine oxide species in the liquid composition. It was also found that these protonated or cationic amine oxides species reduce (i.e., at 10% protonation) or eliminate (i.e., at 90–100% protonation) staining thus increasing the lifetime of the vinyl surface.

The composition herein comprises an acidifying agent having a $pK_a$ of below about 6.0, preferably below about 5.0, more preferably below about 4.0. When selecting an acidifying agent, its $pK_a$ should be less than that of the selected amine oxide, preferably from about 2 to about 3 units less, to provide for maximum protonation of the amine oxide species in the compositions.

The acidifying agent can contain organic acids, inorganic acids, or mixtures thereof. Preferred inorganic acids are $H_2SO_4$, HCl, $HNO_3$, $H_3PO_4$, $HClO_3$ and mixtures thereof. Preferred organic acids are methane sulfonic acid, perchloric acid, glycerolphosphoric acid, ethylenediamine tetracetic acid (EDTA), diethylenetriamine pentaacetic acid (DTPA), maleic acid, mellitic acid, brucine tretrahydrate, benzenepentacarboxylic acid, pyromellitic acid, malonic acid, salicylic acid, hemimellitic acid, 1,4-piperazinebis-(ethanesulfonic) acid, tartaric acid, fumaric acid, citric acid, o-phthalic acid, trimesic acid, dimethymalonic acid, mandelic acid, malic acid, 1,1-cyclohexanediacetic acid, 2-methylpropane-1,2,3-triscarboxylic acid, hippuric acid, tricarballylic acid, formic acid, 3,3-dimethylglutaric acid, 1,1-cyclopentanediacetic acid, itaconic acid, lactic acid, barbituric acid, ascorbic acid, 2,2-dimethylsuccinic acid, succinic acid, benzoic acid, 2,2-dimethylglutaric acid, acetic acid, n-butyric acid and propionic acid. The acidifying agent is more preferably selected from the group of phosphoric acid, nitric acid, hydrochloric acid, perchloric acid, oxalic acid, maleic acid, o-phthalic acid, and mixtures thereof. Most preferred are phosphoric acid, hydrochloric acid, nitric acid, perchloric acid, maleic acid and mixtures thereof.

The liquid compositions contain enough of the acidifying agent to establish a composition pH of between about 3.0 and 7.0, preferably between about 4.0 and about 6.0, more preferably between about 4.0 and about 5.5. Liquid amine oxide compositions employed on hard surfaces at a pH of less than 3.0 tend to harm surface waxes, and when employed at a pH of 7.0 or above will cause excessive staining of vinyl surfaces.

The liquid compositions must also contain enough of the acidifying agent to protonate at least about 10% of the amine oxide species within the composition, preferably between about 50% and about 100%, more preferably between about 90% and 100%. As used herein, the term "protonated" refers to cationic amine oxide species containing a quaternary ammonium group. The protonation or conversion of nonionic to cationic amine oxides is represented generally by the reaction formula $$RR'R''N \rightarrow O + H^+ \rightarrow RR'R''N^+(OH)$$

To achieve the requisite composition pH and amine oxide protonation, the concentration of the selected acid(s) in the liquid compositions will typically be between about 0.05% and about 10%, more typically between about 0.01% and about 7% by weight of the liquid composition. Acid concentrations will vary depending on the $pK_a$ of the amine oxide, the $pK_a$ of the selected acidifying agent, the desired target pH of the composition, and the chemical characteristics of other materials in the composition. Since the inorganic acids tend to have lower $pK_a$ values than the organic acids, target pH values are more easily reached with the inorganic acids. Organic acids are less preferred in the composition because target pH values are more difficult to reach with higher $pK_a$ acids and because they tend to increase composition viscosity making them less desirable for handling and processing reasons. Inorganic acids can be combined with the weaker organic acids to more easily reach the target pH and to better control composition viscosity.

The liquid compositions can be used in diluted or undiluted form on hard surfaces. The compositions will typically be diluted with an aqueous liquid, usually tap water, prior to use. When diluted, the compositions comprise from about 0.004% to about 1.0%, preferably from about 0.01% to about 0.75%, of the amine oxide detergent surfactant. Whether diluted or undiluted, the liquid composition employed on hard surfaces must have the requisite composition pH and amine oxide protonation described herein.

The requisite pH of the composition is maintained by the amine oxide component. Amine oxide detergent surfactants normally have an adequate buffering capacity in the pH range described herein. Even when diluted with tap water, the amine oxide component can normally maintain the composition pH below 7.0. Additional buffers can be added if necessary to help maintain acidity. Such buffers are not usually necessary.

The vinyl staining described herein comes from the dehydrochlorination of polyvinyl chloride surfaces. It is believed that this dehydrochlorination reaction is accelerated by nonacidic amine oxide compositions. This accelerated dehydrochlorination is represented by the reaction formula

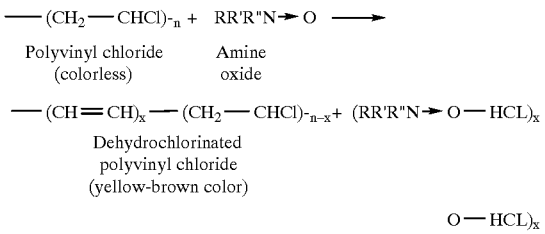

Dehydrochlorinated polyvinyl chloride has a yellow to brown appearance, depending on the degree of dehydrochlorination. This dehydrochlorination is believed to be accelerated by nonionic amine oxide species occasionally found in nonacidic liquid hard surface cleaners. By protonating the amine oxide to the extent described herein, and by maintaining an acidic environment, the rate of dehydrochlorination is greatly reduced and vinyl staining is reduced or eliminated. In the liquid compositions herein, the protonated amine oxides form ion pairs with the deprotonated acidifying agents. These ion pairs are much less reactive in dehydrochlorination reactions and do not penetrate vinyl surfaces as readily as nonionic amine oxide species.

The data summarized in Table 1 shows that mildly acidic, liquid amine oxide compositions of the present invention cause little or no staining when used on vinyl tiles.

TABLE 1

Dilute Product Vinyl Tile Staining From the Use of Liquid Amine Oxide Compositions

| Composition | Coconut dimethyl amine oxide (gm/cc) | Acidfying agent | $pK_a$ of acidfying agent | Concentration of acidfying agent (gm/cc) | Compostion pH | Degree of vinyl staining |
|---|---|---|---|---|---|---|
| K | 0.0023 | none | none | none | 8.0 | severe |
| L | 0.0023 | $H_3PO_4$ | 2.12, 7.12, 12.32 | 0.0003 | 4.6 | none |
| M | 0.0023 | HCl | very low | 0.0003 | 4.7 | light |
| N | 0.0023 | $HNO_3$ | very low | 0.0003 | 4.7 | none |
| 0 | 0.0023 | $H_2SO_4$ | very low | 0.0001 | 4.6 | light |
| P | 0.0023 | Maleic acid | 2.00, 6.26 | 0.0003 | 4.7 | none |
| Q | 0.0023 | Oxalic acid | 1.19, 4.21 | 0.0002 | 4.7 | light |
| R | 0.0023 | Ethylene diamine tetraacetic acid | 1.7, 2.6, 6.3, 10.6 | 0.0004 | 4.6 | none |
| S | 0.0023 | 0-Phthalic acid | 3.10, 5.27 | 0.0005 | 4.6 | light |
| T | 0.0023 | Succinic acid | 4.19, 5.57 | 0.0004 | 4.8 | light |
| U | 0.0023 | Tartaric acid | 3.02, 4.54 | 0.0003 | 4.6 | light |
| V | 0.0023 | Citric acid | 3.06, 4.74, 5.40 | 0.0004 | 4.6 | light |
| W | 0.0023 | Malic acid | 3.40, 5.05 | 0.0004 | 4.6 | light/ moderate |
| X | 0.0023 | Acetic acid | 476 | 0.0003 | 4.9 | moderate |

To generate the data summarized in Table 1, the following vinyl staining method was employed. This method accelerates staining but it correlates well with long term vinyl staining under normal conditions in the field. In accordance with this method, white vinyl floor tiles were rinsed with warm tap water, rinsed twice with isopropanol, and then allowed to air dry. About 1 cc of each composition K-X was separately applied to discreet regions of the tiles. The tiles were kept at room temperature for 1 hour and then placed in an oven at 60° C. (140° F.) for 1 hour, 45 minutes. The tiles were removed from the oven and allowed to cool to about room temperature. The cooled tiles were rinsed with tap water. The treated regions on each tile were then visually inspected for vinyl staining. The degree of staining was rated as "none" (no color change), "light" (very slight but noticeable discoloration), "moderate" (yellow color change) or "severe" (brown color change). Each composition K-X was a 1:128 dilution of a liquid concentrate with a pH of about 4.5. After dilution, each composition as applied to the tiles had a pH of between about 4.5 and 5.0. Each diluted composition therefore consisted of water, coconut dimethyl amine oxide, and a specific acidifying agent.

Composition K was the control product. It had a pH of about 8.0. Essentially 100% of the amine oxide surfactant was therefore in nonionic form. This composition caused severe staining.

Compositions L-R were mildly acidic amine oxide compositions where 90–100% of the amine oxide species were protonated with acidifying agents having $pK_a$ values below about 3.0. Compositions L-R caused little or no vinyl staining.

Compositions S-X contained weaker acids ($pK_a$ values above about 3.0) which caused only light to moderate staining. Note however, that all of the mildly acidic compositions (L-X) caused significantly less staining than composition K which had a much higher pH (8.0) and therefore had less than 10% of its amine oxide species in cationic form.

Aqueous Carrier Liquid

The compositions herein are employed on hard surfaces in liquid form. Accordingly, the foregoing components are admixed with an aqueous carrier liquid. The choice of aqueous carrier liquid is not critical. It must be safe and it must be chemically compatible with the components of the compositions. It should be either neutral or acidic to minimize the amount of acidifying agent needed.

The aqueous carrier liquid can comprise solvents commonly used in hard surface cleaning compositions. Such solvents must be compatible with the components of the compositions and must be chemically stable at the mildly acidic pH of the compositions. They should also have good filming/residue properties. Solvents for use in hard surface cleaners are described, for example, in U.S. Pat. No. 5,108,660, which is incorporated herein by reference.

Preferably, the aqueous carrier liquid is water or a miscible mixture of alcohol and water. Water-alcohol mixtures are preferred inasmuch as the alcohol can aid in the dispersion and dissolution of the amine oxide and other materials in the compositions. Moreover, the alcohol can be used to adjust the viscosity of the compositions. The alcohols are preferably $C_2$–$C_4$ alcohols. Ethanol is most preferred.

Most preferably, the aqueous carrier liquid is water or a water-ethanol mixture containing from about 0% to about 50% ethanol.

Non-liquid Formulation

The present invention also embodies a non-liquid composition from which the mildly acidic, liquid hard surface cleaning compositions can easily be obtained by adding an aqueous carrier liquid. The non-liquid compositions can be in granular, powder or gel forms, preferably in granular forms.

The non-liquid compositions comprise from about 1% to about 50%, preferably from about 2% to about 30%, more preferably from about 2.5% to about 25%, of the amine oxide detergent surfactant described herein.

The non-liquid compositions also comprise an acidifying agent as described herein, preferably an organic acidifying agent. The non-liquid compositions contain enough of the acid to provide, upon dilution with the aqueous carrier liquid, a pH and percent amine oxide protonation within the ranges described herein for the mildly acidic, liquid compositions.

The non-liquid gel compositions contain reduced amounts of the non-aqueous carrier liquid. The non-liquid granular compositions contain substantially no aqueous carrier liquid. In either form, an aqueous carrier liquid is added to the non-liquid composition prior to use to form the mildly acidic, liquid hard surface cleaning compositions of the present invention.

Auxiliary Materials

Optionally, the compositions herein can contain auxiliary materials which augment cleaning and aesthetics.

The compositions can optionally comprise a non-interfering auxiliary surfactant in addition to the amine oxide detergent surfactant. Additional auxiliary surfactants can effect cleaning activity. A wide variety of organic, water soluble surfactants can optionally be employed. The choice of auxiliary surfactant depends on the desires of the user with regard to the intended purpose of the compositions and the commercial availability of the surfactant.

The compositions can contain any of the anionic, nonionic and zwitterionic/amphoteric surfactants commonly employed in liquid hard surface cleaning compositions.

Examples of compatible auxiliary surfactants useful in the compositions are set forth below. The term "alkyl" used to describe these various surfactants encompasses the hydrocarbyl alkyl groups having a chain length of from about $C_8$ to $C_{22}$, i.e., materials of the type generally recognized for use as detergents. Suitable surfactants which can be employed in the compositions herein include anionic surfactants such as the alkyl sulfates, alkyl benzene sulfonates, olefin sulfonates, fatty acyl isethionates and taurides, alkyl sulfoccinates, alkyl ether sulfates ($AE_2SO_4$) and many others.

Examples of suitable nonionic surfactants include the polyethoxysorbitan esters, fatty acyl mono- and di-ethanol amides, $C_8$–$C_{22}$ ethoxylates and mixed coconut ethoxylates containing 1 to 30 ethoxylate groups.

Examples of suitable zwitterionic surfactants include the fatty alkyl betaines and sulfobetaines and similar compounds such as $C_8$ to $C_{18}$ ammonio propane sulfonate and $C_8$ to $C_{18}$ hydroxy ammonio propane sulfonates.

The anionic surfactants can be in the form of their water soluble salts, for instance the amine, ammonium, alkanolammonium or alkali metal salts. For most purposes it is preferred to use the anionic materials in their acid form to reduce the amount of auxiliary acid needed to acidify the composition. Especially preferred anionic surfactants herein the alkyl ether sulfates of the general formula $AE_xSO_4$ wherein A=$C_{10}$–$C_{22}$ alkyl, E is ethylene oxide, and wherein x is an integer from 0 to 30; the $C_{10}$–$C_{14}$ olefin sulfonates, and mixtures thereof.

Optionally, and preferably, the compositions contain water miscible substances having disinfectants properties. Preferred disinfectants are quaternary ammonium compounds, which are well known in the detergency art. Examples of suitable quaternary ammonium disinfectants include didecyl dimethyl ammonium chloride, N-alkyl ($C_{12}$ to $C_{18}$) dimethyl ammonium chloride, and N-alkyl ($C_{12}$ to $C_{18}$) dimethyl ethyl benzyl ammonium chloride.

Other optional additives such as perfumes, brighteners, enzymes, colorants, and the like can be employed in the compositions to enhance aesthetics and/or cleaning performance. These additives must be acidic or neutral, they must be compatible with the active components in the composition, and they should not interfere with the inhibition of vinyl staining provided by the compositions.

Detergent builders can also be employed in the compositions. These builders are especially useful when auxiliary surfactants or cosurfactants are employed, and are even more useful when the compositions are diluted prior to use with exceptionally hard tap water., e.g., above about 12 grains. Detergent builders sequester calcium and magnesium hardness ions that might otherwise bind with and render less effective the auxiliary surfactants or cosurfactants. The detergent builders can be employed in the compositions at concentrations of between about 0% and about 10%.

Alkaline builder materials are not useful herein since they will interfere with the acidulation of the composition. Instead, the optional builder materials should comprise acidic or neutral sequestrants which do not interfere with the inhibition of vinyl staining provided by the instant composition. Acidic or neutral builder materials include, for example, water soluble polycarboxylic acids (e.g., acrylic and maleic acid polymers and copolymers), polysulfonic acids, aminopolyacetic acids, and the like.

Suds suppressors are especially useful in the composition. In the hard surface cleaning composition herein, suds formation and maintenance are undesirably promoted by the amine oxide component. The compositions therefore preferably comprise a sufficient amount of a suds suppressor to prevent excessive sudsing during employment of the compositions on hard surfaces. Suds suppressors are especially useful to allow for no-rinse application of the composition.

The suds suppressor can be provided by known and conventional means. Selection of the suds suppressor depends on its ability to formulate in the compositions, and the residue and cleaning profile of the compositions. The suds suppressor must be chemically compatible with the components in the compositions, it must be functional at the pH range described herein, and it should not leave a visible residue on cleaned surfaces.

Low-foaming cosurfactants can be used as suds suppressor to mediate the suds profile in the compositions. Cosurfactant concentrations between about 1% and about 3% are normally sufficient. Examples of suitable cosurfactants for use herein include block copolymers (e.g., Pluronic® and Tetronic®, both available from BASF Company) and alkoxylated (e.g., ethoxylated/propoxylated) primary and secondary alcohols (e.g., Tergitol®, available from Union Carbide; Poly-Tergent®, available from Olin Corporation).

The optional suds suppressor preferably comprises a silicone-based material. These materials are effective as suds suppressors at very low concentrations. The compositions preferably comprise from about 0.01% to about 0.50%, more preferably from about 0.01% to about 0.3%, of the silicone-based suds suppressor. At these low concentrations, the silicone-based suds suppressor is less likely to interfere with the cleaning performance of the compositions. Examples of suitable silicone-based suds suppressors for use in the compositions include Dow Corning®g AF-2210 and Dow Corning® AF-GPC, both available from Dow Corning Corporation.

These optional but preferred silicone-based suds suppressors can be incorporated into the composition by known and conventional means. Such materials are typically water insoluble and require suspension in the aqueous environment of the compositions. The silicone-based suds suppressors are typically suspended by either increasing the viscosity of the liquid compositions or by matching the specific gravity of the compositions with that of the silicone-based suds suppressor. The specific gravity of the compositions can be increased to that of the silicone-based suds suppressor, for example, by adding a low level of a cosurfactant. A preferred cosurfactant for this purpose are betaine zwitterionic surfactants, preferably at concentrations of from about 0.5% to about 3%.

Benefits

In addition to their effect on vinyl staining described hereinbefore, the compositions also have excellent cleaning properties and leave little or no visible residue on hard surfaces when they dry.

It was found that these compositions leave surprisingly little or no visible residue on hard surfaces whether used in a rinse or no-rinse application. As described hereinbefore, at least about 10% of the amine oxide species in the composition are cationic. Cationic surfactants, however, tend to form crystalline salts upon drying thus resulting in cloudy residues. This does not occur, however, with the application (rinse or no-rinse application) of the instant compositions to hard surfaces.

It was also found that the compositions exhibit excellent particulate and greasy soil removal properties. This was surprising since acidic liquid hard surface cleaners do not typically clean particulate or greasy soil from hard surfaces as well as non-acidic hard surface cleaners do. Acidic hard surface cleaners are used mostly in bathrooms to remove hard water stains.

The compositions provide excellent soil removal properties while also leaving little or no visible residue on cleaned surfaces. Hard surface cleaners typically have either good soil removal properties or good residue properties (e.g., they do not leave a visible residue on cleaned surfaces), but not both. The compositions herein provide both of these desirable properties in a single product. It is therefor uniquely suited to clean, for example, heavily soiled shiny surfaces, e.g., waxed vinyl floors.

FIG. 1 is a graph showing the relationship between particulate soil removal properties (vertical axis) and residue forming properties (horizontal axis) for the several hard surface cleaning samples A–F listed below. These properties for samples A–F correspond to points A–F on the graph.

Sample A: Ecolab Oasis 266 All Purpose Cleaner 266
- Labeled ingredients
- nonyphenol ethoxylate
- n-alkyl ($C_{12-16}$) dimethyl benzyl ammonium chloride
- sodium ethylene diamine tetracetic acid
- water Sample B: Scott #8 Neutral Floor Cleaner
- Labeled ingredients
- butoxyethanol
- alkylnaphthalene sodium sulfonate
- sodium citrate
- nonylphenol ethoxylate
- water Sample C: S. C. Johnson G.P-Forward
- Labeled ingredients
- sodium hydroxide
- sodium silicate
- nonylphenol ethoxylate
- potassium hydroxide
- water Sample D: S. C. Johnson Stride
- Labeled ingredients
- $C_{12-18}$ ethoxylated/propoxylated alcohol
- citric acid
- sodium citrate
- water Sample E: Butcher #4 Neutral Floor Cleaner
- Labeled Ingredients
- isopropanol
- nonylphenol ethoxylate Sample F: Example 1 composition
- Ingredients
- coconut dimethyl amine oxide
- Betaine
- Dow Corning® AF-2210

Phosphoric acid
Hydrochloric acid
Dye/Perfume
Deionized water (q.s. to 100%)
pH=4.0

Samples A–F are tested for residue formation on hard surfaces using the following method. Each sample is diluted to recommended usage with tap water (about 8 grain hardness) at between about 30° and about 38° C. (between about 86° and about 100° F.). About 5 grams of each d sample is applied to a folded lint-free towel wrapped around a small block, which is then used to apply the sample in one swipe lengthwise alone a clean 3×12 inch chrome panel. After the applied sample dries, the residue remaining on the chrome panel is graded on an absolute scale of 0.0 (extremely visible residue) to 5.0 (no visible residue). The residue grade for each sample is then plotted along the horizontal axis of the graph in FIG. 1.

Samples A–F are also tested for the ability to remove particulate soil from hard surfaces using the following method. White vinyl floor tiles are rinsed with warm tap water, rinsed twice with isopropanol, and allowed to dry. Particulate soil suspended in isopropanol (4.0 gram soil/6.0 grams isopropanol/tile) is rubbed onto each tile with a lint-free paper towel. Once the isopropanol evaporates and the excess soil is brushed away, the tiles are washed with samples A–F using a Gardner Straight Line Washability Machine. Percentage of particulate soil removed by each sample is determined by reflectance measurements using Hunter Lab Tristimulus Colorimeter (DP-9000) before and after washing. Values representing the percentage of soil removed by each sample is then plotted along the vertical axis of the graph in FIG. 1.

It can be seen in FIG. 1 that Sample F, which is a composition of the present invention, is superior to samples A–E both in cleaning performance and in residue formation. This represents a significant departure from the trend seen in no-rinse hard surface cleaners that cleaning performance should decrease as residue formation tendencies decrease. Unlike most no-rinse hard surface cleaners, Sample F exhibits excellent cleaning properties and residue/filming (i.e., leaves little or no visible film on cleaned surfaces) properties.

Method of Use

The present invention has been fully set forth in its composition aspects. The invention also encompasses a method for cleaning vinyl surfaces (waxed or unwaxed). The benefit of using this composition on vinyl surfaces is described hereinbefore.

The method comprises applying to a vinyl surface the mildly acidic liquid compositions herein or, preferably, applying an aqueous dilution thereof. The vinyl surface is then wiped with a porous material,. e.g., cloth or mop, and allowed to dry.

In a preferred method, the mildly acidic liquid composition is first diluted with an aqueous liquid, preferably tap water. The diluted composition has a pH of between about 3.0 and 7.0, preferably between about 4.0 and about 6.0, and comprises from about 0.02% to about 0.2%, preferably from about 0.04% to about 0.1%, of the amine oxide detergent surfactant described herein. At least about 10% of the amine oxide species in the diluted composition are protonated, preferably from about 50% to about 100%, more preferably from about 90% to about 100%. The diluted composition is then applied to and wiped over (with a porous material) the vinyl surface and allowed to dry.

III. EXAMPLES

The following examples illustrate the compositions of the present invention, but are not intended to be limiting thereof.

| | |
|---|---|
| Example 1 | |
| Coconut dimethyl amine oxide | 9.0% |
| Betaine | 1.0% |
| Dow Corning ® AF-2210 | 0.3% |
| Phosphoric acid | 1.5% |
| Hydrochloric acid | 1.4% |
| Dye/Perfume | 0.8% |
| Deionized water (q.s. to 100%) | pH = 4.0 |
| Amine oxide protonation | 95–100% |
| Example 2 | |
| Coconut dimethyl amine oxide | 29.0% |
| Dow Corning ® AF-2210 | 0.3% |
| Phosphoric acid | 1.2% |
| Maleic acid | 1.5% |
| Dye/Perfume | 0.8% |
| Deionized water (q.s. to 100%) | pH = 4.0 |
| Amine oxide protonation | 95–100% |
| Example 3 | |
| Coconut dimethyl amine oxide | 29.0% |
| Dow Corning ® AF-GPC | 0.06% |
| Nitric Acid | 1.5% |
| Dye/Perfume | 0.8% |
| Deionized water (q.s. to 100%) | pH = 5.0 |
| Amine oxide protonation | 75–85% |

What is claimed is:

1. Mildly acidic vinyl/floor surface cleaning compositions, consisting essentially of:

a) from about 1% to about 60% of coconutalkyl dimethyl amine oxide detergent surfactant;

b) an aqueous carrier liquid;

c) from about 0.05% to about 10% of an acidifying agent having a $pK_a$ of less than about 6.0; and d) a suds suppressor; and e) water miscible substances having disinfectant properties wherein the pH of the liquid composition is between 3.0 and 7.0 and at least about 10% of the amine oxide detergent surfactant within the composition is protonated.

2. A composition according to claim 1 wherein the pH of the liquid composition is between about 4.0 and about 6.0, and between about 90% and 100% of the amine oxide detergent surfactant within the liquid composition is protonated.

3. A composition according to claim 2 wherein the acidifying agent has a $pK_a$ of less than about 4.0.

4. A composition according to claim 1 wherein the acidifying agent is s elected from the group consisting of phosphoric acid, nitric acid, hydrochloric acid, perchloric acid, maleic acid, o-phthalic acid, and mixtures thereof.

5. A composition according to claim 4 wherein the acidifying agent is selected from the group consisting of phosphoric acid, hydrochloric acid, nitric acid, perchloric acid and mixtures thereof.

6. A composition according to claim 1 wherein said composition comprises from about 2.0% to about 50% of the amine oxide detergent surfactant.

7. A composition according to claim 1 wherein said water miscible substances having disenfectant properties comprises a quaternary ammonium disinfectant.

8. Granular floor cleaning compositions, consisting essentially of a) from about 1% to about 60% of coconutalkyl dimethyl amine oxide detergent surfactant;

b) an acidifying agent having a $pK_a$ of less than about 6.0; and c) a suds suppressor; and d) water miscible substances having disinfectant properties wherein said composition can be diluted with an aqueous carrier liquid to form a liquid composition having a pH between 3.0 and 7.0 and at least about 10% of the amine oxide detergent surfactant within the liquid composition is protonated.

9. A composition according to claim 8 wherein the acidifying agent is an organic acid.

* * * * *